US005265280A

United States Patent [19]

Walsh

[11] Patent Number: 5,265,280

[45] Date of Patent: Nov. 30, 1993

[54] FACIAL SCREEN WITH CONNECTING ELASTIC

[76] Inventor: Michael Walsh, 85 Highwood Ave., Midland Park, N.J. 07432

[21] Appl. No.: 875,989

[22] Filed: Apr. 29, 1992

[51] Int. Cl.[5] ..... A62B 23/00

[52] U.S. Cl. ..... 2/206; 2/4; 2/9; 2/171; 2/172; 128/206.12; 128/206.19

[58] Field of Search ..... 2/9, 4, 10, 15, 206, 2/207, DIG. 7, 171, 172, 173, 199, 185 R, 209, 207; 128/201.17, 206.19, 205.29, 863, 206.12; 604/303, 308, 393

[56] References Cited

U.S. PATENT DOCUMENTS

| | | | |
|---|---|---|---|
| D. 249,397 | 9/1978 | Humphrey et al. | D2/233 |
| D. 257,698 | 12/1980 | Skottheim | D2/231 |
| D. 265,350 | 7/1982 | Davis | D2/233 |
| D. 267,128 | 11/1982 | Pearce | 2/233 |
| D. 270,014 | 8/1983 | Lutzker | D2/230 |
| D. 274,385 | 7/1984 | Newcomb | D2/234 |
| D. 277,520 | 2/1985 | Gregory | D2/233 |
| D. 278,380 | 4/1985 | Verdick | D2/234 |
| D. 284,710 | 7/1986 | Hatchman | D2/241 |
| D. 288,980 | 3/1987 | Pernicka | D29/17 |
| D. 292,438 | 10/1987 | Lyke | D29/17 |
| D. 293,840 | 1/1988 | Parrish | D29/17 |
| D. 293,932 | 7/1988 | Ramseyer | D24/36 |
| D. 296,941 | 7/1988 | Ieutholt et al. | D29/15 |
| D. 298,178 | 10/1988 | Kikuch et al. | D29/7 |
| D. 298,179 | 10/1988 | Strong | D29/17 |
| D. 299,372 | 1/1989 | Rhoden et al. | D21/196 |
| D. 300,571 | 4/1989 | Waters | D28/44 |
| D. 306,363 | 2/1990 | Stackhouse et al. | D29/17 |
| D. 307,065 | 4/1990 | Friedman | D29/17 |
| D. 307,954 | 5/1990 | Alber | D29/17 |
| D. 309,962 | 8/1990 | Ebeling | D29/17 |
| D. 311,262 | 10/1990 | Curry | D29/17 |
| D. 311,263 | 10/1990 | Russel | D29/17 |
| D. 311,978 | 11/1990 | Metcalfe | D29/17 |
| D. 314,452 | 2/1991 | Accardi | D29/17 |
| D. 317,063 | 5/1991 | Johnson | D29/17 |
| 1,279,884 | 9/1918 | La Roche | 128/863 X |
| 2,056,753 | 10/1936 | Wagner | 128/206.19 |
| 2,494,406 | 1/1950 | Reitano | 128/206.19 |
| 2,565,124 | 8/1951 | Durboron | 2/206 X |
| 2,634,725 | 4/1953 | Lo Presti | 2/174 |
| 3,292,182 | 12/1966 | Schiessler | 2/173 |
| 3,419,907 | 1/1969 | Spain | 2/174 |
| 3,582,991 | 6/1971 | Metz | 2/8 |
| 3,664,335 | 5/1972 | Boucher et al. | 128/863 |
| 4,014,047 | 3/1977 | Zobel | 128/206.19 |
| 4,173,795 | 11/1979 | Lundin et al. | 2/425 |
| 4,229,836 | 10/1980 | Stinger | 2/422 |
| 4,229,837 | 4/1977 | Solari | 2/431 |
| 4,300,240 | 11/1981 | Edwards | 2/206 |
| 4,300,242 | 11/1981 | Nava et al. | 2/412 |
| 4,428,079 | 1/1984 | McKee | 2/174 |
| 4,736,466 | 4/1988 | Kallstrom | 2/9 |
| 4,736,469 | 4/1988 | Boretti | 2/411 |
| 4,790,307 | 12/1988 | Haber et al. | 128/206.19 |
| 4,847,921 | 7/1989 | Leutholt et al. | 2/206 |
| 4,897,064 | 11/1990 | Che | 441/124 |
| 4,941,211 | 7/1990 | Blutstein | 2/202 |
| 4,945,574 | 8/1990 | Dagher | 2/9 |
| 4,951,660 | 8/1990 | Lubitzsch | 128/201.27 |
| 4,957,124 | 9/1990 | Mooney | 132/200 |
| 4,961,232 | 10/1990 | Hulsey | 2/206 |
| 4,966,139 | 10/1990 | Swiatosz | 128/205.23 |
| 4,975,981 | 12/1990 | Ray | 2/10 |
| 4,979,236 | 12/1990 | Merrill et al. | 2/4 |

(List continued on next page.)

*Primary Examiner*—Clifford D. Crowder
*Assistant Examiner*—Jeanette E. Chapman
*Attorney, Agent, or Firm*—Klauber & Jackson

[57] ABSTRACT

A one-piece facial screen comprised of a lightweight mesh-like covering (24) which is patterned and proportioned to cover the mouth and chin area with an expandable material (20), and two lightweight fabric connections (17) and (17*a*) whereby the upper line of said connections continues up and over the wearer's cheekbone but not so high as to cover the temples. Two apertures (22) and (22*a*) means are contained in said connections to allow the skin to breathe. Said connections are attached to a lightweight easily expandable material as a backing (14) with a top stitching means running throughout the facial screen with connecting elastic.

13 Claims, 6 Drawing Sheets

U.S. PATENT DOCUMENTS

| | | | |
|---|---|---|---|
| 4,984,302 | 1/1991 | Lincoln | 2/206 |
| 4,986,267 | 1/1991 | Doss | 128/201.27 |
| 5,016,625 | 5/1991 | Hsu et al. | 128/201.25 |
| 5,025,506 | 6/1991 | Huang | 2/206 |
| 5,025,507 | 6/1991 | Kirby | 2/206 |
| 5,035,004 | 7/1991 | Koester | 2/206 |
| 5,035,006 | 7/1991 | Hetz et al. | 2/206 X |
| 5,038,776 | 8/1991 | Harrison et al. | 128/207.1 |
| 5,054,479 | 10/1991 | Yelland et al. | 128/201.25 |
| 5,054,480 | 10/1991 | Bare et al. | 128/201.25 |
| 5,062,421 | 11/1991 | Burns et al. | 128/205.27 |
| 5,067,174 | 11/1991 | Ritchey et al. | 2/173 X |
| 5,069,205 | 12/1991 | Urso | 128/201.24 |
| 5,072,460 | 12/1991 | Weder | 2/206 |
| 5,080,092 | 12/1992 | Tenna | 128/201.19 |
| 5,080,094 | 12/1992 | Tayebi | 128/205.9 |

FACIAL SCREEN WITH CONNECTING ELASTIC

BACKGROUND

Field of Invention

This invention relates to a facial screen with connecting elastic specifically used while exercising.

CROSS-REFERENCE TO RELATED APPLICATIONS

I have filed a Disclosure Document Number 297,448 relating to this application.

DISCUSSION OF PRIOR ART

A variety of protective facial masks are known. I have categorized the prior art into four groups (a) sports masks, (b) shop-setting masks, (c) sanitary-setting masks and (d) a miscellaneous group. I will briefly discuss the inability of each group to satisfy the need to which my invention is directed.

(a) Sports masks are designed for a number of purposes. Some masks are designed to prevent injury to the athlete from being hit by a playing object. For example, U.S. Pat. No. 257,698 to Skottheim (1978) is a Goalie Mask For A Hockey Player. A second example, U.S. Pat. No. 4,173,795 to Lundin, Bravin (1978) is a Racquetball or Squash Mask. While suited to this particular purpose these coverings do nothing to enhance the athlete's outdoor aerobic workout. Cold weather masks are also unsatisfactory because they fail to provide an acceptable covering for the mouth area during aerobic exercise. For example, U.S. Pat. No. 4,300,240 to Edwards (1979) shows a Cold Weather Face Mask. U.S. Pat. No. 4,941,211 to Blutstein (1989) shows a cold weather Hood. U.S. Pat. No. 274,385 to Newcomb (1981) shows Ski Goggle Nose and Face Guards. These masks would also be uncomfortable in a warm weather environment.

(b) Shop-setting masks seek to prevent injury to the employee in the workplace. Shop-setting, like some sports masks, protect the employee from being hit with objects in the workplace. For example, U.S. Pat. No. 306,363 to Stackhouse, Williamson (1987); 307,065 to Friedman (1987) and 4,945,574 to Dagher (1989) show face shields. Masks in this group are unsatisfactory for two reasons. First, these masks do nothing to help an athlete with his or her aerobic workout. Second, the structure of the masks are often cumbersome and thereby impractical for a person exercising.

(c) Sanitary-setting masks are worn by workers in situations where a sterile environment is important. For example, U.S. Pat. No. 5,067,174 to Ritchey, Reeves (1990) and 311,262 to Curry (1987) are face shields. These masks do not allow for free breathing and therefore are not well suited to an individual looking to exercise.

(d) Masks in the Miscellaneous Group are designed for various purposes. For example, U.S. Pat. No. 307,954 to Alber (1987) is a Costume Mask. A second example, U.S. Pat. No. 4,979,236 to Merrill, Biron (1989) is an Insect Protective Garment. A third example, U.S. Pat. No. 5,062,421 to Burns, Reischel (1991) is a Respiratory Mask having a Soft Compliant Facepiece and a Thin Rigid Insert and Method of Making. No mask in the group however is suited for use during exercise in an insect/polluted environment.

OBJECTS AND ADVANTAGES

Accordingly, several objects and advantages of my facial screen with connecting elastic are:

a) solves the above-described problem associated with prior art of heaviness and being cumbersome by providing a lightweight covering.

b) provides a movable/removable protective screen for the mouth area.

c) provides covering for the mouth area that also can be secured by the chin.

d) reduces the problems associated with perspiration by providing a wash and wear reusable item.

e) provides a unisex item.

f) provides an elastic backing which allows for size differences and a proper fit.

Still further objects and advantages will become apparent from a consideration of the ensuing description and drawings.

DRAWING FIGURES

In the drawings, closely related figures have the same number but different alphabetic suffixes.

FIGS. 1 and 1*a* show various aspects of the covering with connecting elastic backing to the screen and chin covering with a front and side view.

FIG. 2 shows the elastic backing curved as it would go around the head.

FIG. 2*a* shows the detail of the elastic backing.

REFERENCE NUMERALS IN DRAWINGS

Figure 1:
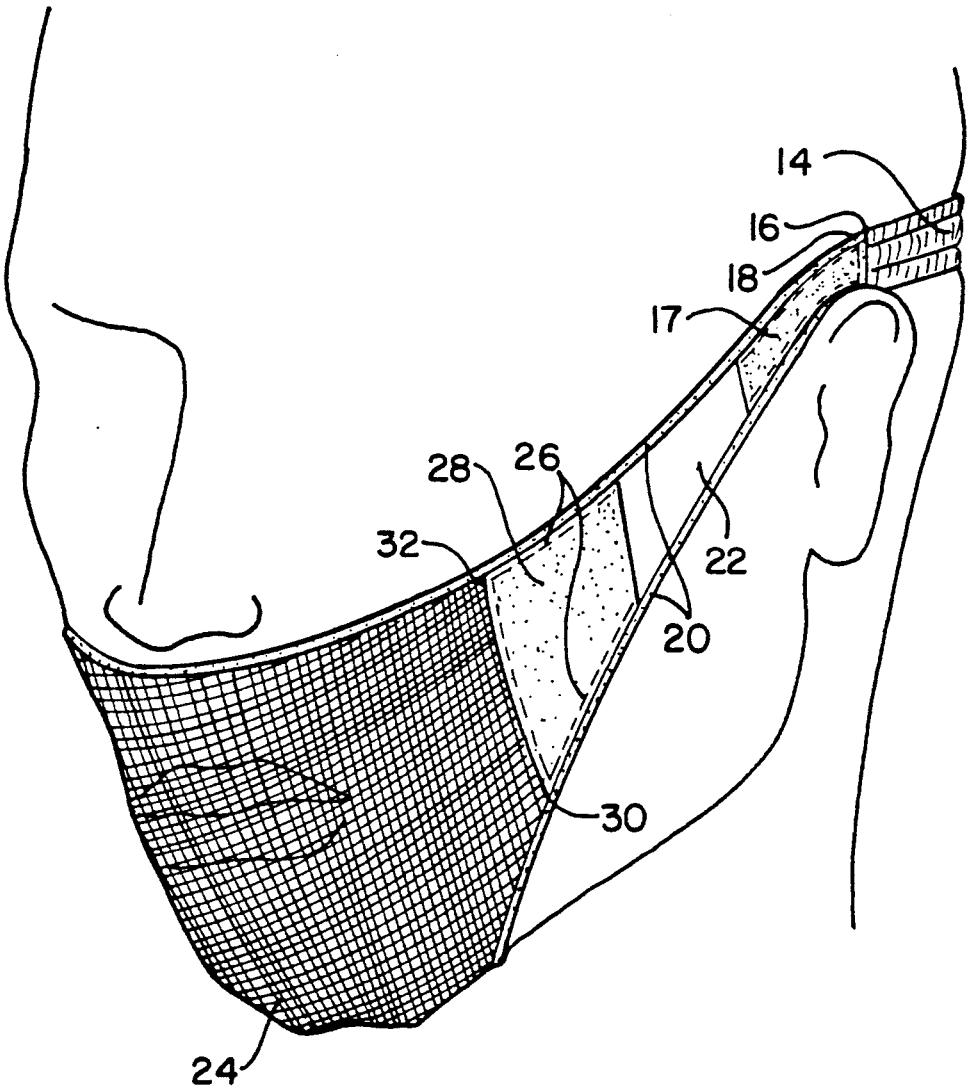

14 elastic backing
16 reinforced top stitching which joins the lightweight breathable cloth material 17 to the elastic backing
16*a* reinforced top stitching which joins the lightweight breathable cloth material 17*a* to the elastic backing on the other side
17 lightweight breathable cloth material
17*a* lightweight breathable cloth material on the other side
18 point where the upper and lower elastic cording 20 originates from 17
18*a* point where the upper and lower elastic cording 20 originates from 17*a* on the other side
20 elastic cording running from 18 to 18*a*
22 aperture
22*a* aperture-other side
24 mesh covering including holes in various sizes so as to be better suited for different mosquito infestations
26 top stitching running complimentary with the elastic cording
28 area for the product name
28*a* area for the product name on the other side
30 point where the mesh covering joins 17
30*a* point where the mesh covering joins 17*a*
32 point where the mesh covering joins 17
32*a* point where the mesh covering joins 17*a*

DESCRIPTION OF THE FACIAL SCREEN WITH CONNECTING ELASTIC

Figure 1A:
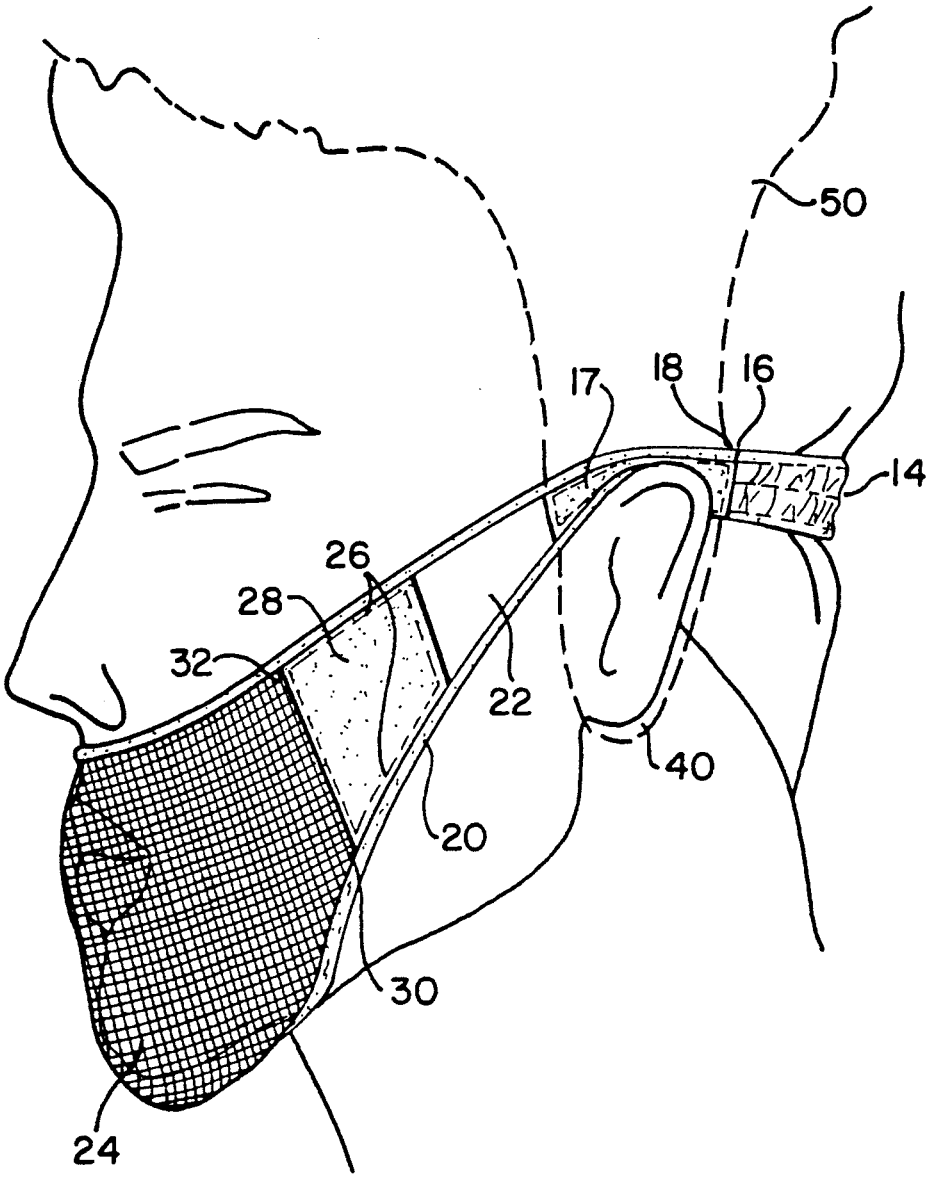
Figure 2:
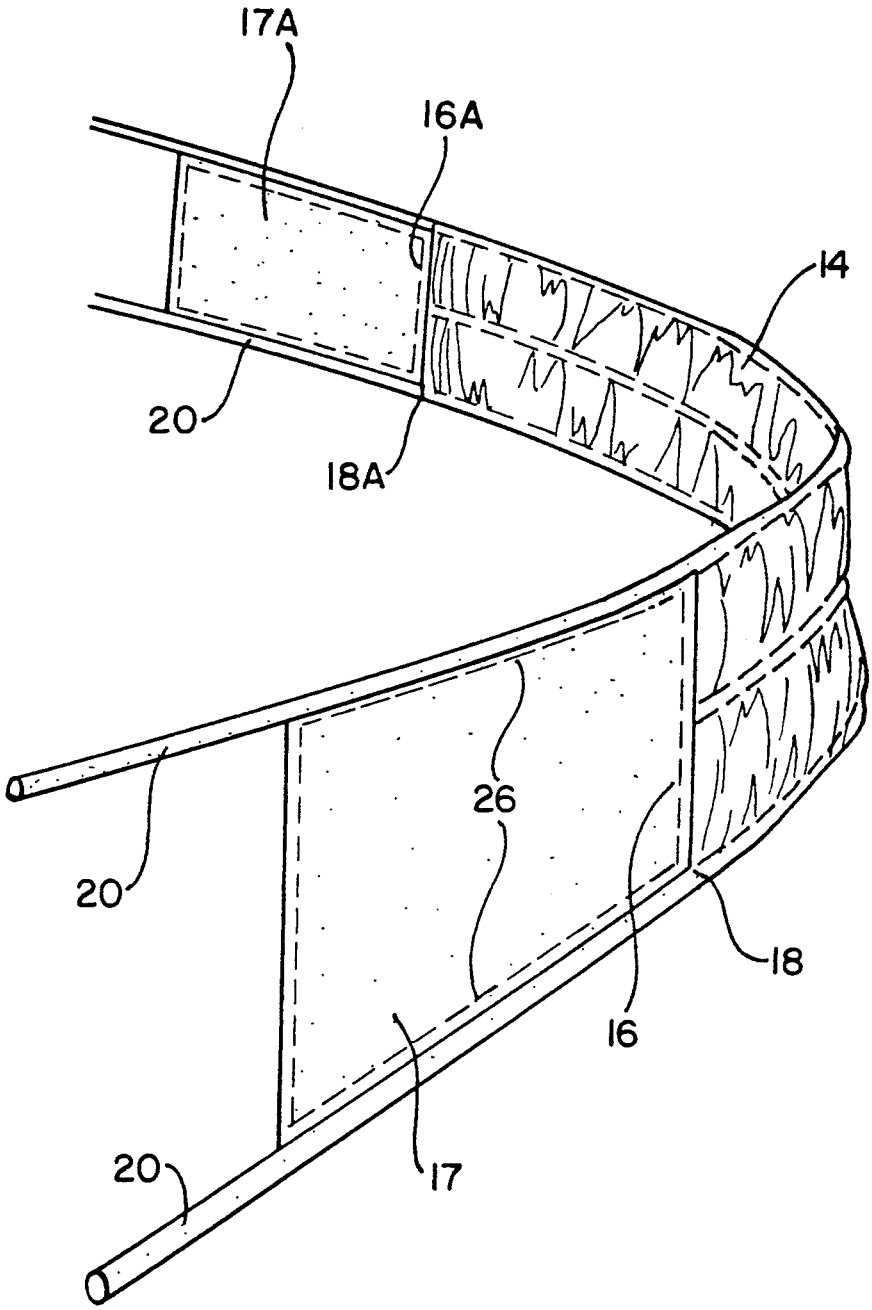
Figure 2A:
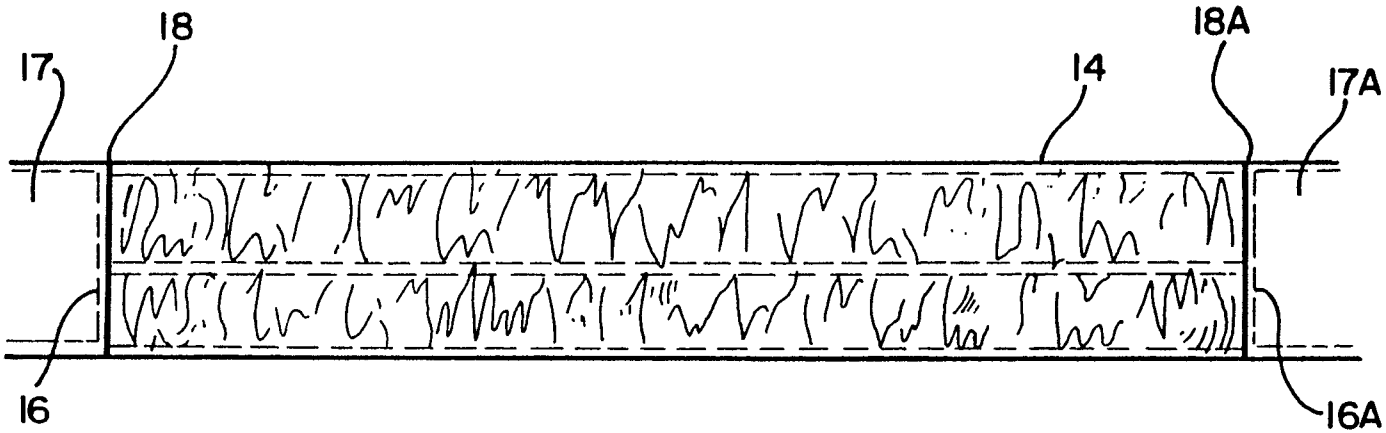
Figure 3:
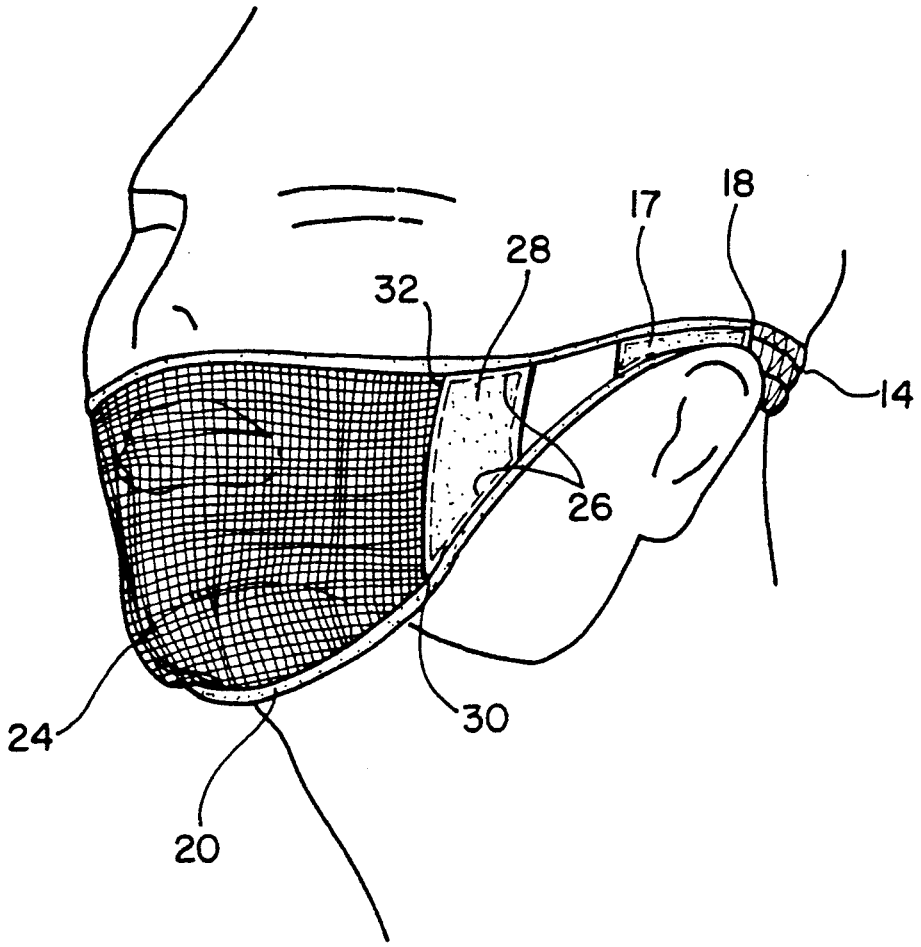
FIG. 3 shows the mesh covering on the head.
Figure 4:
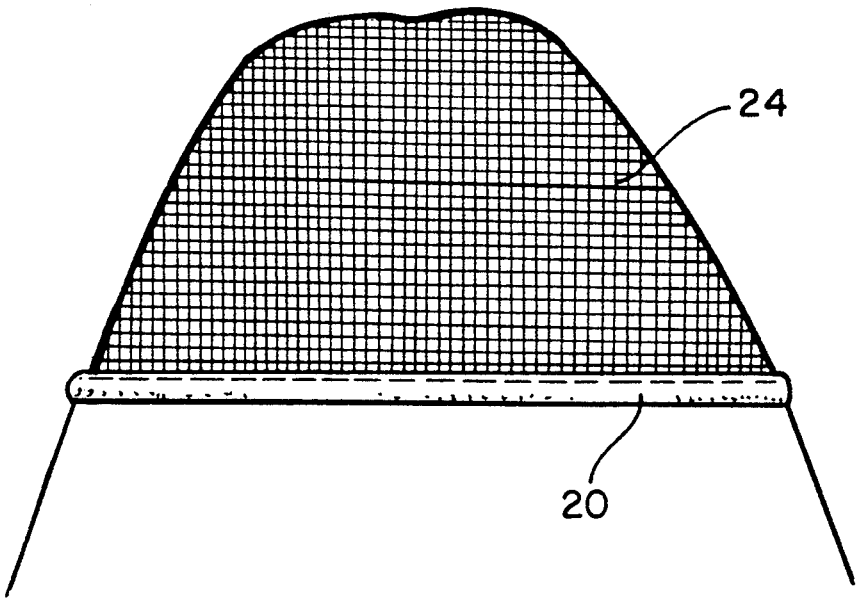
FIG. 4 shows the elastic cording and mesh covering running under the chin.

With reference to FIGS. 1 and 1*a* of the drawings, the elastic backing 14 has a ripple construction as a result of an elastic strip as a base covered with a fabric material. This function compensates for size differences and enhances the probability of a proper fit. FIG. 2*a* illustrates the elastic backing 14 as a separate item. The reinforced top stitching 16 and 16*a* joins the elastic backing 14 to the lightweight breathable cloth material 17 and 17*a*. The lightweight breathable cloth 17 and 17*a* widens and decline towards the wearer's chin. The elastic cording 20 originates from 17 and 17*a* at points 18 and 18*a*. The elastic cording 20 allows the covering to conform to the anatomy of the wearer comfortably and securely. FIG. 4 highlights the elastic cording 20 and the mesh covering 24 from under the chin conforming to the anatomy of the wearer. Two apertures 22 and 22*a* are provided in the area of 17 and 17*a* which allows the skin to breathe. Further down on 17 and 17*a*, two areas are provided for the product identification 28 and 28*a*. As shown, the elastic cording 20 runs from 18 and 18*a* above and below 17 and 17*a* and down around the mesh material 24. FIG. 3 shows the mesh covering 24 which extends from points 30 and 30*a* and 32 and 32*a* and enables the wearer to exercise with his/her mouth open. The mesh covering further reduces the likelihood that a foreign body would be ingested. Stitching 26 as shown by the broken line is seen throughout. The facial screen with connecting elastic is shown worn behind the head and above the ears, and covering the chin and mouth area.

OPERATION OF INVENTION

The operation of my facial screen with connecting elastic is straightforward and as follows:

Pull or stretch the elastic backing to get it over the athlete's head.

Allow the entire facial screen with connecting elastic to drop to the athlete's neck.

As the athlete starts to exercise, the mask can be raised as needed.

A two-step process is involved in raising the facial screen with connecting elastic: the elastic backing is stretched and raised to the back of the head and the elastic on the border of the mesh is raised to cover the chin and mouth area.

SUMMARY, RAMIFICATIONS, AND SCOPE

Accordingly, the reader will see that the facial screen with connecting lightweight fabric and elastic backing provides a lightweight economical device which will enhance an individual's workout in certain environments and can be used by persons of almost any age.

While my above description contains many specificities, these should not be construed as limitations on the scope of the invention, but rather as an exemplification of one preferred embodiment thereof. Many other variations are possible. For example:

version which covers the mouth without covering the chin.

version which covers the nose and mouth and could or could not cover the chin.

versions which are the same as above and also act as ear muffs and/or a hat, as shown in phantom in FIG. 1*a* with "ear muff" 40 and "hat" 50.

version wherein the lightweight easily expandable material for the backing is made of another material that can be pressed together or pulled apart.

Accordingly, the scope of the invention should be determined not by the embodiment(s) illustrated but by the appended claims and their legal equivalents.

I claim:

1. A facial screen for the prevention of insect ingestion during exercising, said facial screen comprising a lightweight mesh material which covers at least the mouth of a wearer of said facial screen, said mesh material being joined to first and second fabric material elements, with each of said first and second fabric material elements being adapted to extend along a respective cheek of the wearer, and said first and second fabric material elements being respectively joined to opposite ends of an elastic backing band, wherein at least one elastic cord is attached to each of said first and second fabric material elements and said mesh material, and said at least one elastic cord being separated from the elastic backing band; with said lightweight mesh material, said first and second fabric material elements, said at least one elastic cord, and said elastic backing band comprising a continuous loop to encircle the wearer's head.

2. The facial screen of claim 1, wherein said mesh material has holes therein to permit free breathing and wherein said holes are of a size to prevent insect passage therethrough.

3. The facial screen of claim 2, wherein said mesh material is joined to said first and second fabric material elements by stitching, and said first and second fabric material elements are joined to said elastic band by stitching.

4. The facial screen of claim 2, wherein each of said first and second fabric material elements is comprised of breathable cloth.

5. The facial screen of claim 4, wherein each of said first and second fabric material elements comprises at least one aperture to permit adjacent skin of the wearer to breathe.

6. The facial screen of claim 2, wherein said first and second fabric material elements and said mesh material have respective upper and lower edges, relative to the wearer's head, and wherein said facial screen comprises first and second elastic cords, with said first elastic cord being attached to the upper edges of the first and second fabric material elements and said mesh material, and said second elastic cord being attached to the lower edges of the first and second fabric material elements and said mesh material.

7. The facial screen of claim 6, wherein said first and second elastic cords are attached to respective upper and lower edges of the first and second fabric material elements, adjacent the respective joining of said first and second fabric material elements to said elastic backing band.

8. The facial screen of claim 7, wherein the distance between the upper and lower edges of the first and second fabric material elements increases, from their respective joining to the elastic backing band, to their respective joining to the mesh material.

9. The facial screen of claim 8, wherein said mesh material is adapted to cover the wearer's chin for proper position fixing of said mesh material over the wearer's mouth.

10. The facial screen of claim 2, wherein said first and second fabric material elements further comprise respective extensions to respectively cover ears of a wearer.

11. The facial screen of claim 2, wherein said first and second fabric material elements further comprise extensions to cover the head of a wearer.

12. The facial screen of claim 11, wherein said first and second fabric material elements further comprise respective extensions to respectively cover ears of a wearer.

13. A facial screen for the prevention of insect ingestion during exercising, said facial screen comprising a lightweight mesh material of a size sufficient to cover the mouth but not the nose of a wearer of said facial screen, said mesh material being joined to first and second fabric material elements, with each of said first and second fabric material elements being adapted to extend along a respective cheek of the wearer, and said first and second fabric material elements being respectively joined to opposite ends of an elastic backing band, wherein at least one elastic cord is attached to each of said first and second fabric material elements and said mesh material; with said lightweight mesh material, said first and second fabric material elements, said at least one elastic cord, and said elastic backing band comprising a continuous loop to encircle the wearer's head.

* * * * *